US006312370B1

(12) United States Patent
Allmon

(10) Patent No.: US 6,312,370 B1
(45) Date of Patent: Nov. 6, 2001

(54) CONTAINER FOLDING MACHINE AND PRODUCT THEREOF

(76) Inventor: Gary Allmon, 8426 Broadview Rd., Broadview Heights, OH (US) 44147

( * ) Notice: Subject to any disclaimer, the term of this patent is extended or adjusted under 35 U.S.C. 154(b) by 0 days.

(21) Appl. No.: 09/327,250

(22) Filed: Jun. 7, 1999

Related U.S. Application Data

(63) Continuation-in-part of application No. 08/778,109, filed on Dec. 21, 1996, now Pat. No. 5,909,842, which is a continuation-in-part of application No. 08/624,074, filed on Mar. 29, 1996, now abandoned.

(51) Int. Cl.[7] ..... B31B 7/44; B31B 3/74

(52) U.S. Cl. ..... 493/174; 493/58; 493/143; 229/4.5; 229/104; 229/128; 229/184; 229/400; 53/475

(58) Field of Search ..... 493/58, 59, 63, 493/143, 153, 174, 176; 229/4.5, 5.5, 104, 110, 116.1, 128, 137, 138, 184, 400, 404, 922; 53/475

(56) References Cited

U.S. PATENT DOCUMENTS 3,602,108 * 8/1971 Vuilleumier et al. ..... 493/167
4,208,954 * 6/1980 Chase ..... 493/103
4,778,439 * 10/1988 Alexander ..... 493/169
4,832,675 * 5/1989 Stearns et al. ..... 493/128
5,605,030 * 2/1997 Rodocker ..... 53/484

* cited by examiner

*Primary Examiner*—Peter Vo
*Assistant Examiner*—Hemant M. Desai
(74) *Attorney, Agent, or Firm*—Joseph H. Taddeo

(57) ABSTRACT

A machine for container formation by folding a die-scored paperboard structure to close flaps shaped by the scoring that serve as the top and bottom of the container. A scored paperboard sheet is loaded onto a male pedestal inner pattern such that the foldable top and bottom container portions extend beyond the pattern, whereupon armature driven semicircular outer patterns, having upper and lower fingers adapted to be driven by corresponding fluid driven pin stabilizers, close upon the sheet. While closed over the sheet, the pins are activated to move the fingers inward on the inner pattern and force fold the container along the score lines, followed by automatic retraction of the pins and outer patterns. The container is thus pre-folded in preparation for shipping as a flat paper form that is ready for folding on the crease lines thus formed. One or both flaps of the container can be folded along the crease lines to form a closure at one or both ends. When folded, the flap forms a plurality of inwardly directed pyramidal segments that are crimped along the container axis to form the closure.

25 Claims, 20 Drawing Sheets

CONTAINER FOLDING MACHINE AND PRODUCT THEREOF

REFERENCE TO PREVIOUSLY FILED APPLICATIONS

This application is a C.I.P. of application Ser. No. 08/778,109 filed on Dec. 21, 1996, now U.S. Pat. No. 5,909,842, which in turn is a C.I.P. of application Ser. No. 08/624,074 filed on Mar. 29, 1996, now abandoned.

FIELD OF THE INVENTION

The invention relates to a machine for folding containers, and more particularly to an improved machine for folding a die-scored box blank along score lines impressed by the die. The invention also relates to a prefolded container blank and an assembled container with one or both ends closed with a fanfold closure.

BACKGROUND OF THE INVENTION

Advances in technology now enable construction of containers from a broad variety of materials that may be laminated or otherwise coated. A box folding procedure may be followed in succession by a sealing process, dependent on whether the container is intended for storage of dry or liquid contents.

The initial activity in box folding is scoring the container blank to form segments or box sections that are divided by weakened points which are the score lines. The prior art folding procedure generally provides for advancing container blanks along a conveyor belt to a backing bar where a folding belt engages a box flap edge to fold the flap onto a container panel. The container blanks are thus folded along their score lines for box formation with the designed segments or sections.

The paramount considerations for box folding machines is speed of the operation and minimizing process interruptions, for effective reductions in manufacturing costs.

Therefore, a need exists for a paper box folding apparatus that would enable simple manual alignment of the box blank on the backing bar to form properly proportioned segments according to the box design; that would give folds on the score lines to avoid skewing; and, to achieve the folding process with paramount speed and a minimum of interruptions in the process. In addition to the foregoing, a need exists for an inexpensive paper board container that is easy to assemble and close. These are among the objectives that are achieved by the invention disclosed herein.

SUMMARY OF THE INVENTION

An object of the present invention is to pre-form a plurality of prescored fanform flaps for a container closure speedily and with minimal interruptions to permit subsequent completion of the closure manually or by other means.

Another object is to prepare a prefolded closure for a cylindrical or frustum-shaped container blank whereby subsequent closure of the container is facilitated.

Still another object is a cylindrical or frustum-shaped container having a closure at one or both ends comprising a plurality of fanform pyramidals.

These and other objects are accomplished according to the teachings of the present invention by the use of a container folding machine for construction of containers using box blanks having score lines, in preparation for shipping the containers ready for completion of the container formation by manual folding. The machine comprises a male pedestal in a fixed position that serves as an inner pattern adapted to receive a box blank installed on the inner pattern; a press comprising an outer pattern for closure over the inner pattern with a box blank therebetween; and, a means to crease the paperboard along its score lines for formation of a prefolded container. The pedestal comprises upper and lower edges, and repositioning pedestal fingers pivotally connected along at least one of the edges by pedestal hinges. The hinges are spring loaded to bias the hinges and the fingers between a normal upright position and an inward positions. The press comprises two or more press sides which forms the outer pattern. The press sides include repositioning press fingers that are joined to the press sides by flat hinges and are adapted for inward movement against the inner pattern. Springs interconnect each finger with the press side to which it is hinged to maintain the finger in a normal upright position. An armature controls movement of each press side for closure upon and withdrawal of the press side from the box blank installed on the pedestal. The press includes a hydraulic or pneumatic actuated pin adjacent to a corresponding press finger for engaging the finger to drive the finger inward to contact and to crease the box blank along a score line. Each of the pins is mounted on one or more pin stabilizers surrounding the press and located near the top and/or bottom periphery of each press side. All pins on one stabilizer are connected to a common fluid lead line for simultaneous action thereof. The machine further may include a loading track for positioning a box blank directly adjacent the pedestal and a driver shaft for repositioning a box blank from the loading track for installation on the pedestal.

A further embodiment of the present invention is a machine for prefolding one end of a container blank along score lines, said container blank having an interior surface and an exterior surface. The machine contains a plurality of hinged spring-biased pedestal fingers positioned at spaced intervals around a central pedestal and joined thereto by spring-loaded hinges at spaced intervals, and a plurality of press fingers spaced intermediate said pedestal fingers. Means are included to bias each of the press fingers about a flat hinge from their normal position toward the interior of the container blank and to return the pins to their normal position. The pedestal fingers are adapted to be positioned around the interior surface of the container blank and the press fingers adapted to be positioned around the exterior surface of said blank. The fingers on the press and the pedestal are in the shape of a triangle, generally an isosceles triangle and conform in shape to the score lines on the container blank.

In yet another embodiment, the present invention comprises a container blank in the shape of a frustum or a cylinder for use as a the container comprising a body having at least one opening at one end thereof. The blank contains a plurality of creases to be folded into fanfold ribs around the opening. The creases are formed by the steps of creating a plurality of score lines around the periphery of the opening to form contiguous triangles; placing the blank in a creasing machine containing a plurality of triangular fingers whereby the fingers are in registry with the contiguous triangles; and actuating the fingers to form creases in the blank along the score lines around the opening. The fingers are composed of a plurality of press fingers spaced apart from one another around the outside of the opening of the container blank, and an equal number of pedestal fingers intermediate the press fingers around the inside of the opening of the blank. The press fingers cause the periphery of the opening to move in on itself, and the pedestal fingers resist the inward movement of the periphery thereby creating the creases.

In yet another embodiment of the invention, a container having a closure at one end is composed of a plurality of fanfold ribs round the periphery of the container. The ribs are formed by the steps of a) preparing a container blank in the form of a frustum or a cylinder; b) creating a plurality of score lines around the periphery of the container blank to form contiguous triangles; c) placing the container blank in a creasing machine containing a plurality of triangular hinged fingers whereby the fingers are in registry with the triangles; d) activating the fingers to form creases along the score lines; e) removing the container blank from the machine, and f) folding the periphery of the container blank along the creases to form a plurality of inwardly directed ribs serving as the closure for the container. The container can have a circular or frusto-conical cross section whereupon each of the triangles around the periphery thereof comprises an isosceles triangle having a height equal to the radius of the closure. The fingers are composed of a plurality of press fingers spaced apart from one another around the outside of the container blank, and an equal number of pedestal fingers intermediate the press fingers around the inside of the container blank.

In still another embodiment of the present invention, a container is described which is cylindrical or frustoconical in shape. The container has a central axis and peripheral borders at either end defining fold lines. At least one of the two ends is closable with a fanfold closure which comprises a plurality of pyramidal segments, each segment composed of a first set of two isosceles triangles with their bases forming a portion of the end fold line and a second set of two isosceles triangles with their bases forming an axially extending crimp line. All of the triangles have a height equal to the radius of the container at the closure. The bases of the first set of triangles are contiguous to one another along the end fold line, and adjacent triangles form divergent planes as they extend from the base to the axis. Adjacent triangles in the second set diverge from one another as they extend from the container axis to the end fold line, each triangle terminating along the fold line at the intersection between the bases of contiguous triangles in the first set. The two sets of triangles are at right angles to the second set. The pyramidal segments are in non overlapping relationship to one another. Each end fold line is in a single plane, and the peripheral edge of the container blank before forming the closure is in a single plane.

Additional features of this invention will become apparent as indicated herein. And further advantages will be apparent to those of ordinary skill in the art upon reading and understanding the following detailed description.

DETAILED DESCRIPTION OF THE PREFERRED EMBODIMENT

Figure 1:
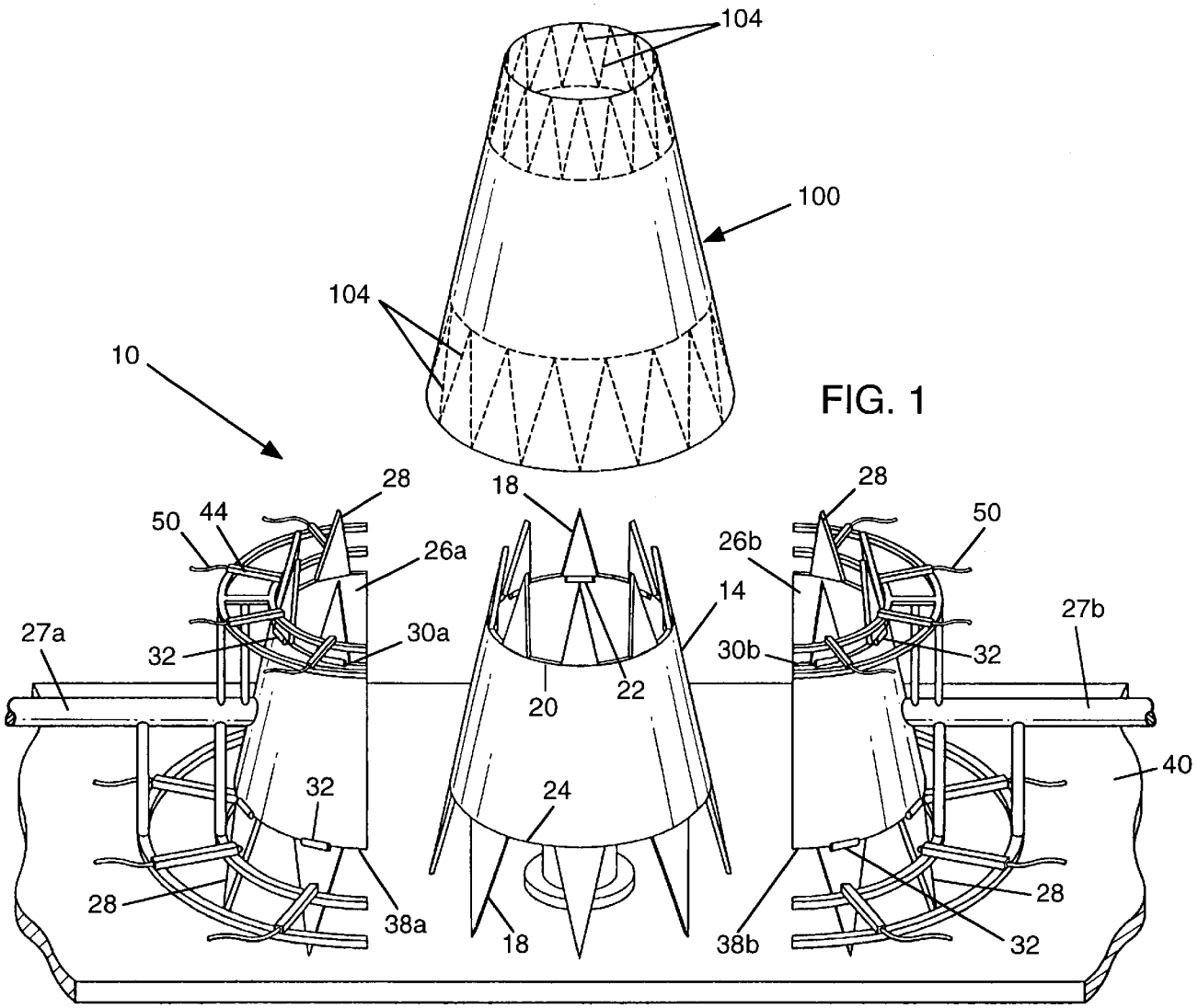
FIG. 1 is an elevation view in perspective with the box blank descending on the pedestal inner pattern with the press sides ready for closure.

It will be understood by Reference to FIG. 1, that the container folding machine 10 disclosed herein comprises a central pedestal 14 having upper edge 20 and lower edge 24. A plurality of triangular repositioning pedestal fingers 18 are pivotally joined to, and extend upward from upper edge 20. Additional repositioning pedestal fingers are pivotally joined to and extend downward from the lower edge 24 of the pedestal. The central pedestal 14 forms an inner pattern which serves as a backing bar or plate for each of the box blanks 100 that is processed for folding.

In FIG. 1, a frusto-conical box blank 100, having score lines 104, is positioned on the pedestal 14 that is an inner pattern with the press sides 26*a*,26*b* ready for closure. Each of the pedestal fingers 18 is adapted for inward movement in the folding process and return to its upright position by its interconnection with the pedestal 14 with spring loaded hinges 22, such that each pedestal finger 18 is normally in the upright position.

Figure 2:
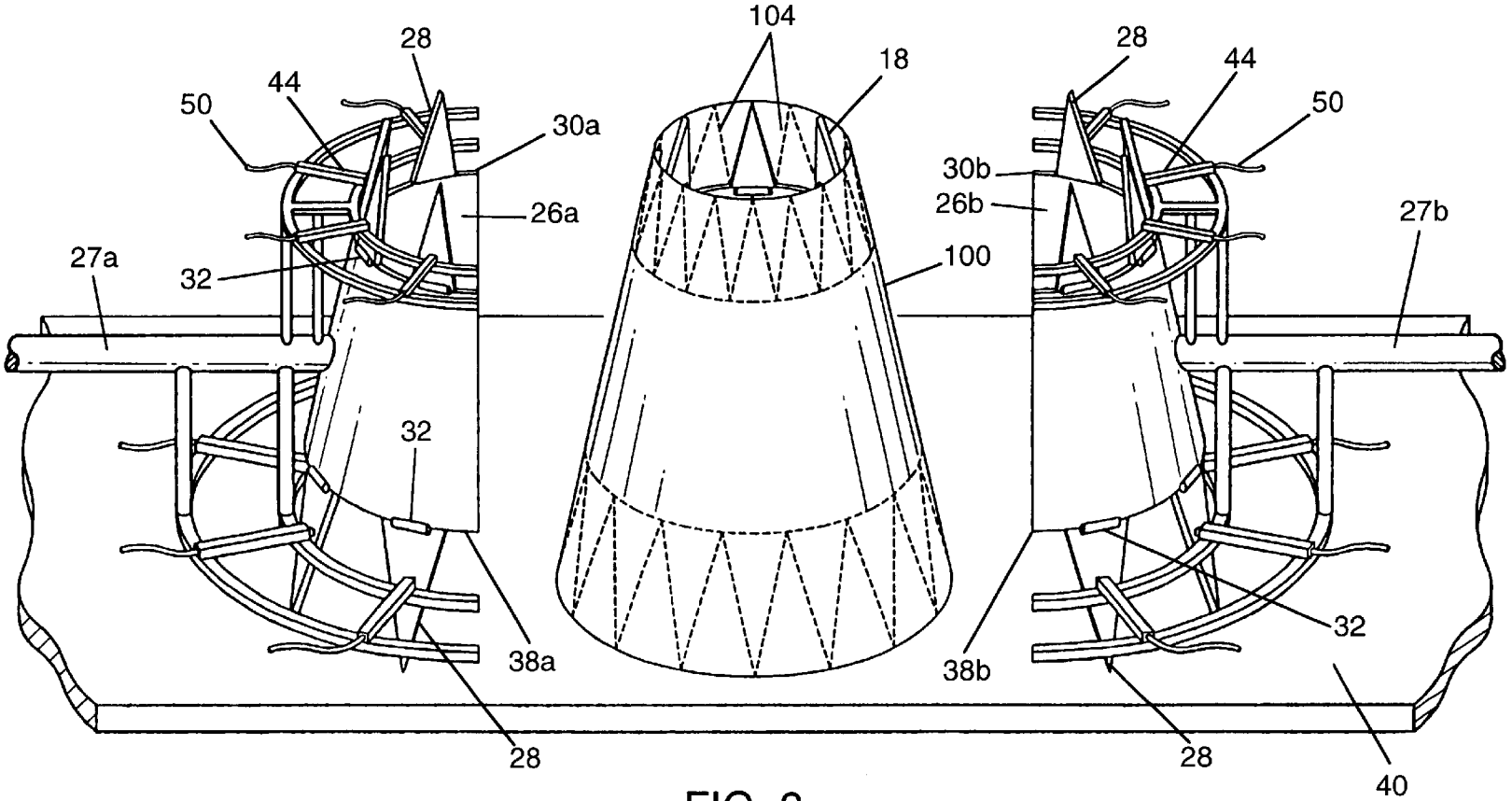
FIG. 2 discloses the folding machine with the blank installed on the pedestal.

Referring to FIG. 1 and FIG. 2, the press sides 26*a*,26*b*, are correspondingly shaped to fit over the pedestal 14. The press sides 26*a*,26*b* form an outer pattern that is adapted for closure over the inner pattern to crease the box blank 100, which is preferably a paperboard material, along its score lines 104 for formation of a pre-folded container 108. The press sides have a top periphery 30*a*, 30*b* and a bottom periphery 38*a*,38*b*.

It will be understood that while the pedestal 14 shown here is a frustum, the pedestal 14 may have cylindrical, square, rectangular, multi-sided or other forms for construction of similarly shaped boxes with one or more collapsible, reclosable ends. Furthermore, the triangular pedestal fingers 18 shown here, may have other shapes analogous to the top and bottom segments of a particular die-cut box blank 100.

Each of the press sides 26*a*,26*b* is also equipped with projecting, repositioning press fingers 28, that are each triangular in shape and are adapted for inward movement by interconnection to the top periphery 30*a*,30*b* and the bottom periphery 38*a*,38*b* of each press side 26*a*,26*b*, by means of a flat hinge 32. When the press sides close around the pedestal, the triangular press fingers and the pedestal fingers are in alternate positions around the peripheral edge of the box blank.

Movement of the press sides 26*a*,26*b* is controlled by a respective armature 27*a*,27b, connected to a central joint or knuckle (not shown), that allows the armatures to move in and out, e.g. by operation of foot pedals (not shown), for closure upon, and withdrawal from, the pedestal 14. Meanwhile, pedestal 14 is fixed in stable position upon a horizontal deck 40.

Figure 3:
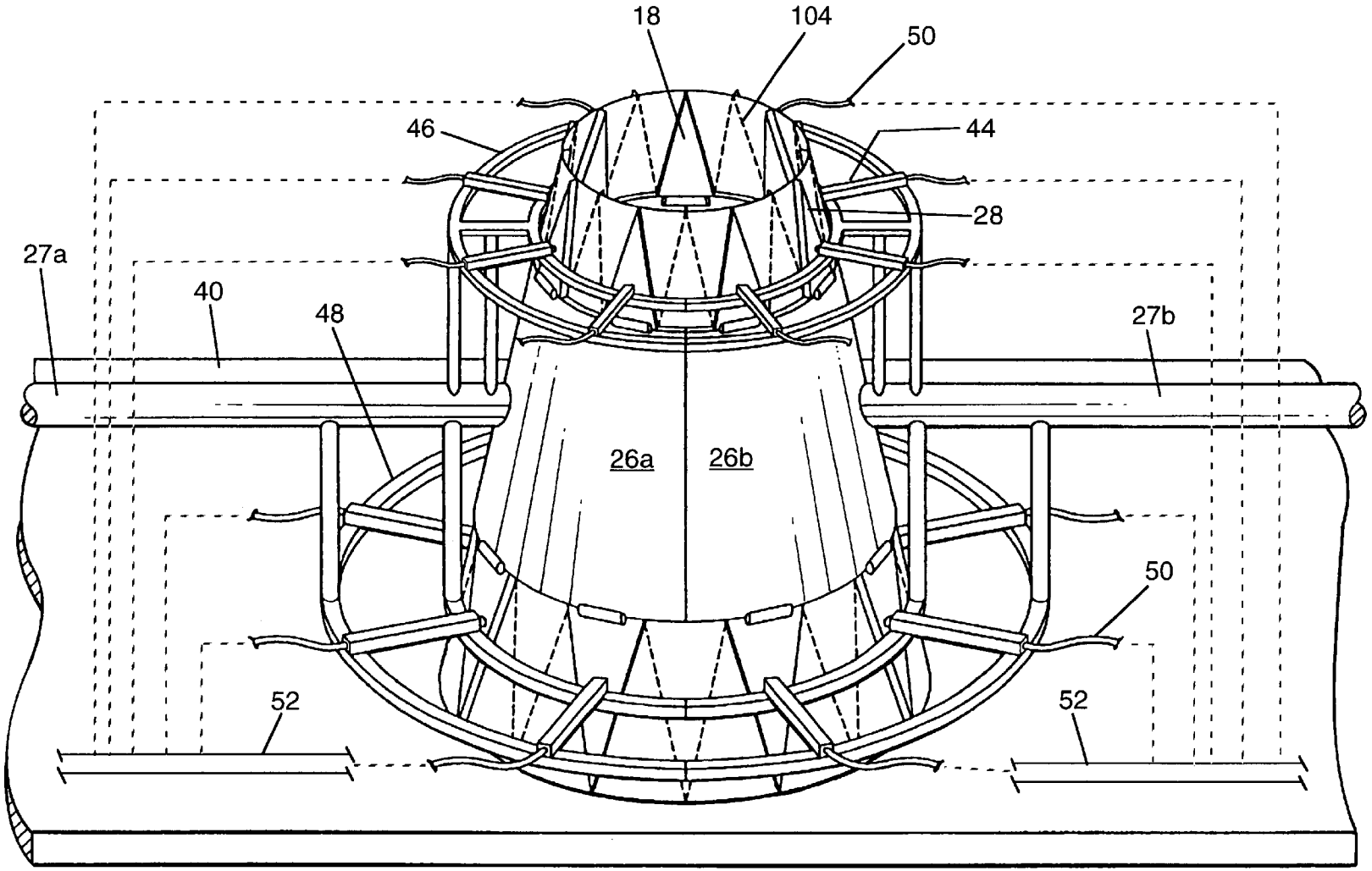
FIG. 3 shows the equipment in operative condition with the press sides closed over the container blank on the pedestal.
Figure 4:
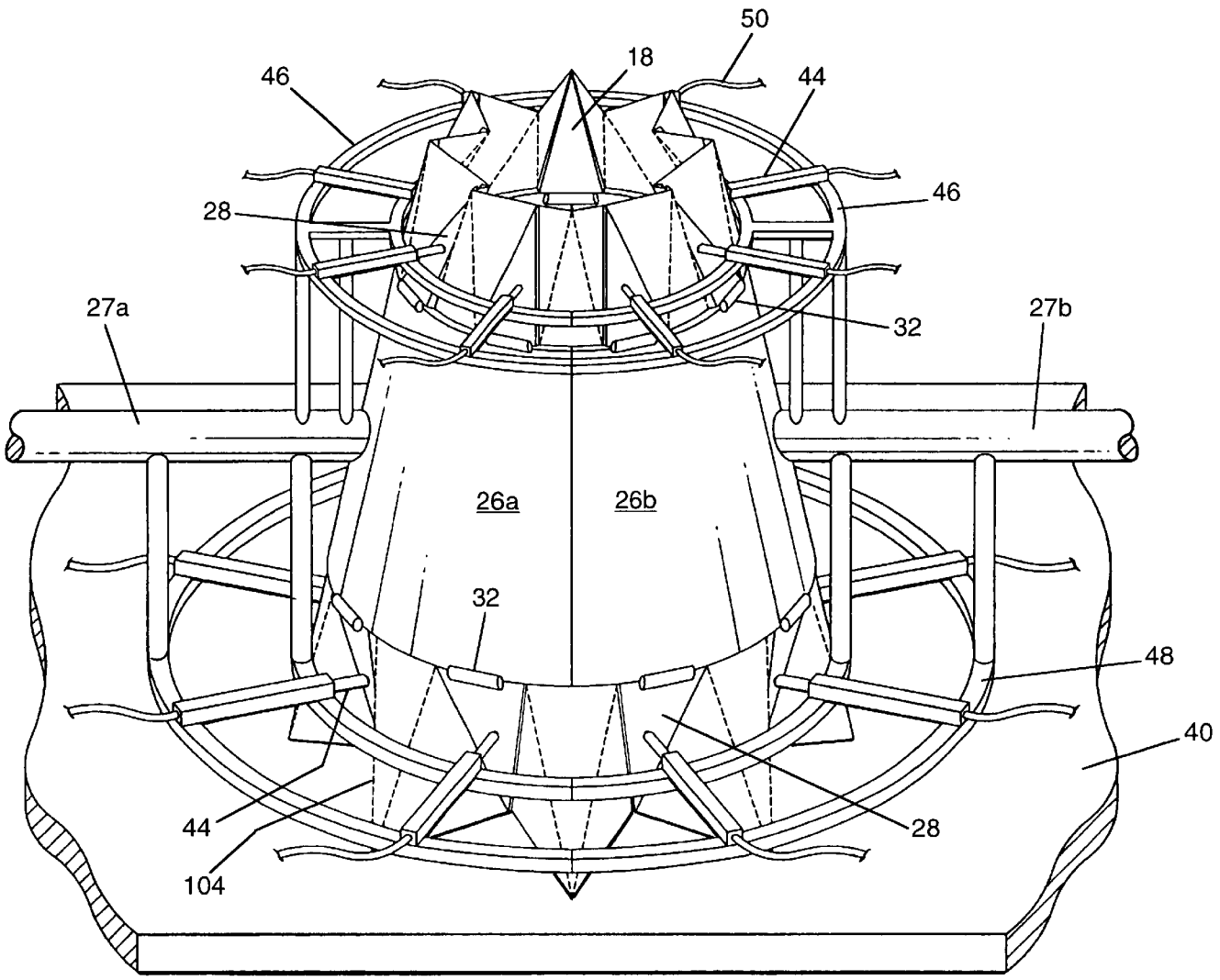
FIG. 4. shows the operative state of the equipment when the press is closed and the contact fingers pressured inward.
Figure 5:
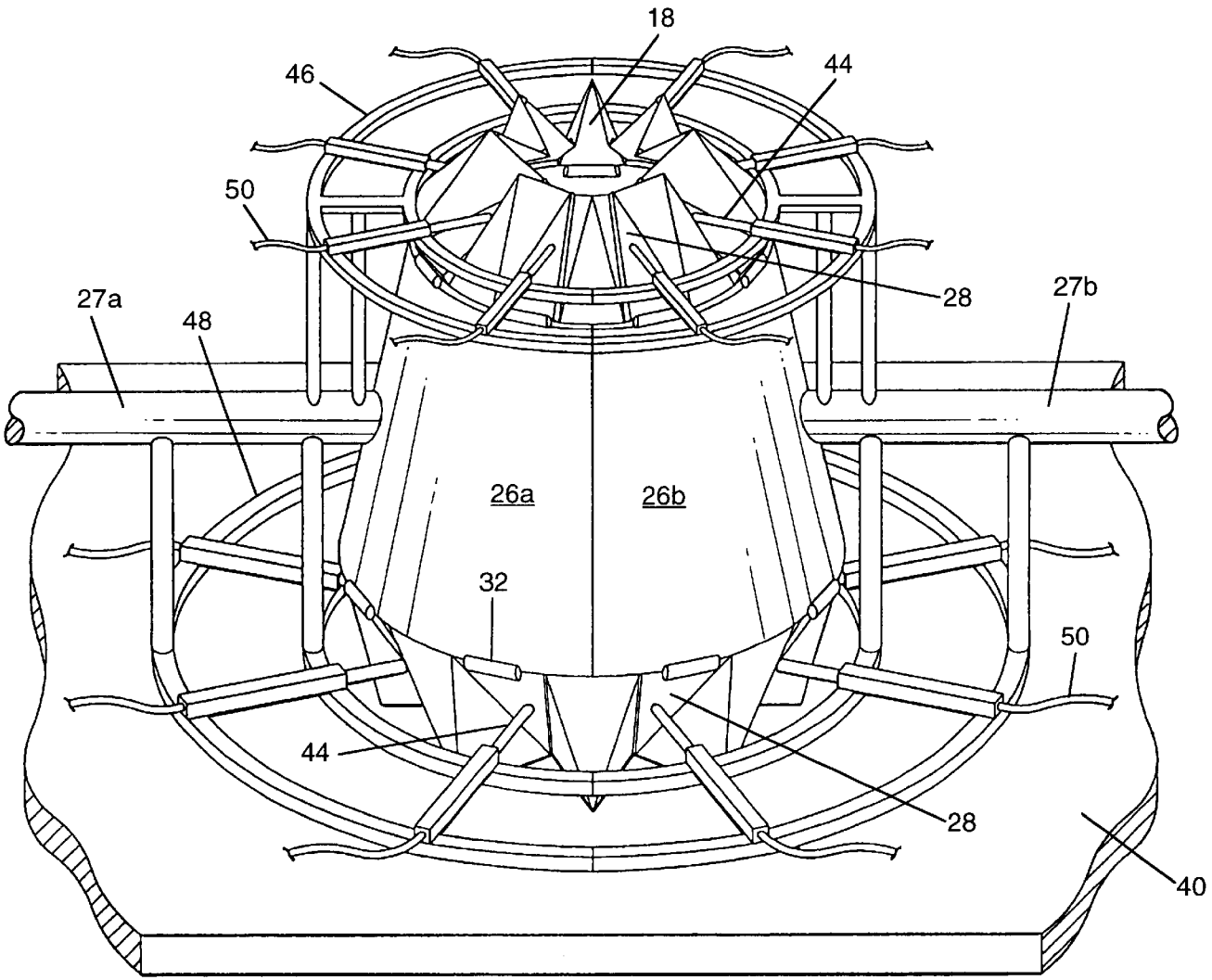
FIG. 5 shows the machinery in operation when the press is closed, the contact fingers pressured inward, and the fingers are fully engaged to form creases to prefold the box.

The box blank is aligned for conformity of its segments with the pedestal fingers 18, upon installation on the pedestal as illustrated in FIG. 3, FIG. 4, and FIG. 5. When the press sides 26*a*,26*b* are closed over the pedestal 14, with the box blank 100 therebetween, then pins 44 that are mounted on upper and lower pin stabilizers, 46,48 of each of the press sides 26*a*,26*b*, and positioned adjacent a corresponding press finger 28 thereof, are simultaneously driven inward. Each pin 44 communicates through its respective lead line 50 to a common line (not shown) that communicates with a fluid container or tank (not shown) holding a fluid medium under pressure.

The preferred fluid medium is compressed air to provide the force necessary to drive the pins 44 inward; and, each of the pins 44 is in fluid communication with the others through the common line 52 for simultaneous action of the pins 44 engaging respective press fingers 28. When the pins 44 have fully engaged fingers 28, the box creases are formed on designated score lines 104 for consequent pre-folding of each box.

Figure 6:
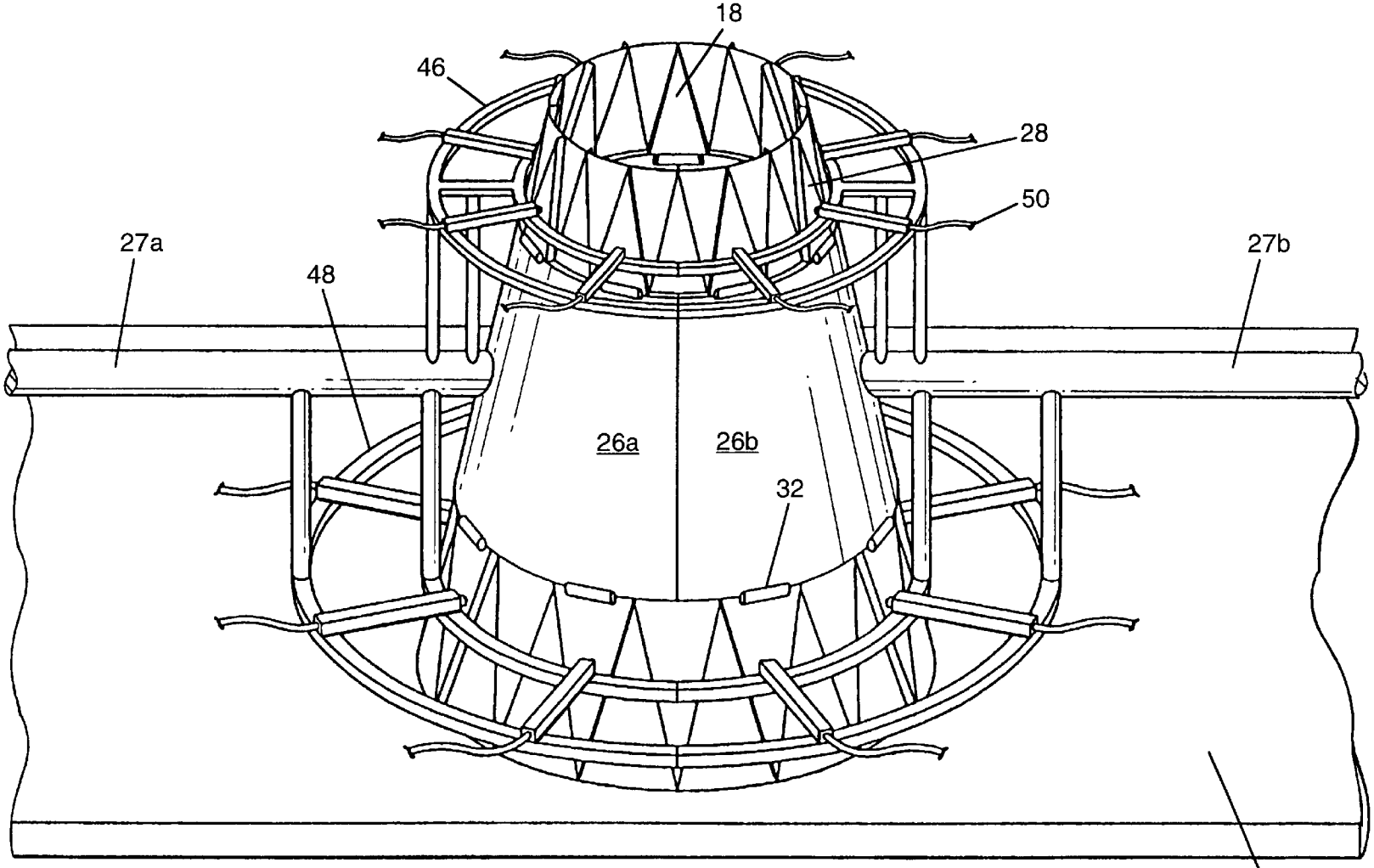
FIG. 6 discloses the equipment having the fingers withdrawn after the box has been pre-folded and prepared for manual closure.
Figure 7:
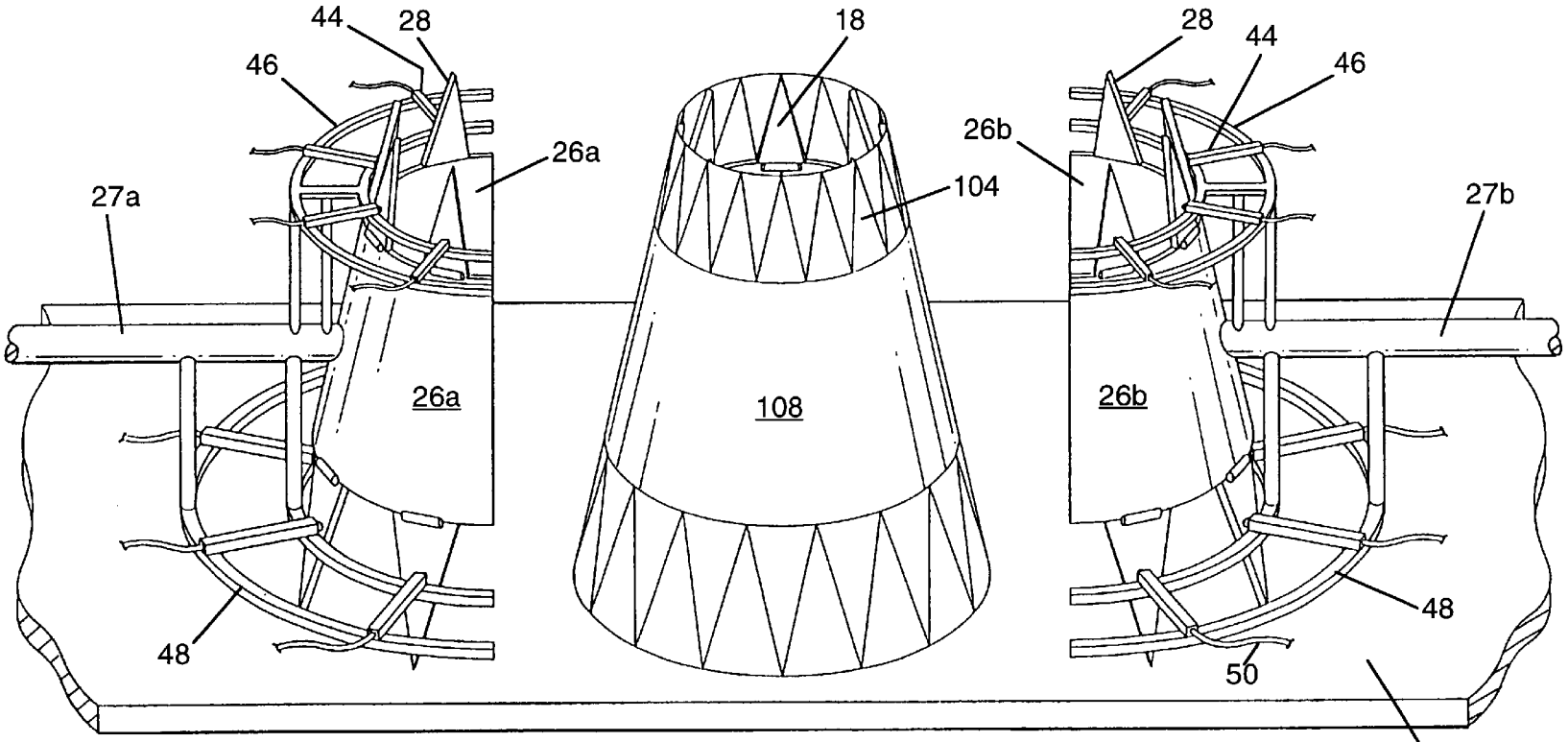
FIG. 7 discloses the equipment when the press sides have been withdrawn.

Referring now to FIG. 6 and FIG. 7, following their full engagement with the fingers 28, the pins 44 are withdrawn to facilitate removal of the pre-folded box 108, that is now prepared for closure on machine made crease lines corresponding to the score lines 104.

Figure 8:
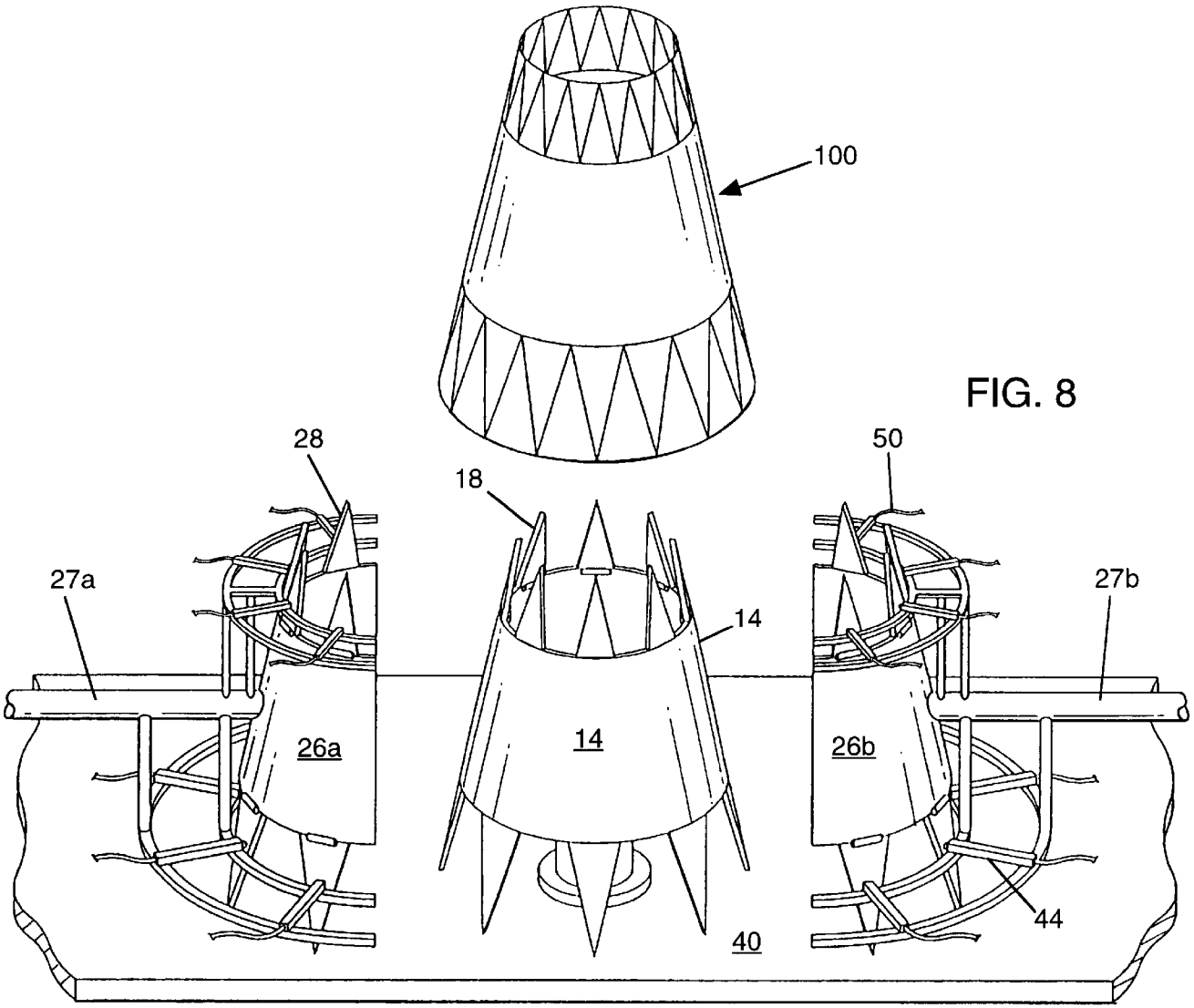
FIG. 8 discloses removal of the pre-folded box and readiness of the machinery for installation of another blank on the pedestal.

As disclosed in FIG. 7 and FIG. 8, the press sides 26*a*,26*b*, are then withdrawn by radial movement of the armatures 27*a*,27*b*, to facilitate removal of prefolded box 108, in readiness for installation of the succeeding box blank 100 on the pedestal 14.

Figure 9:
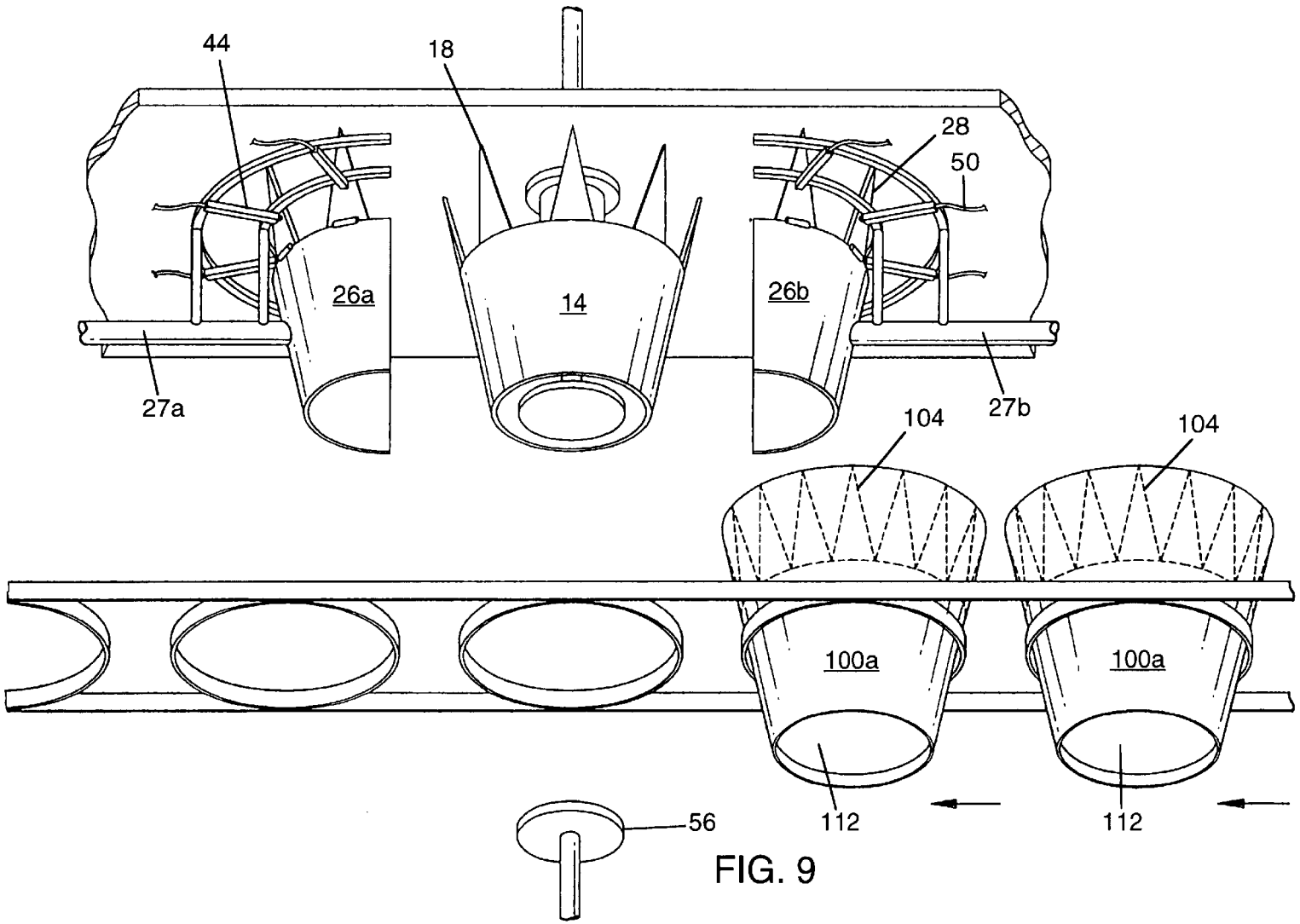
FIG. 9 is an elevation view showing a loading track for box blanks having a flat, pre-sealed bottom.
Figure 10:
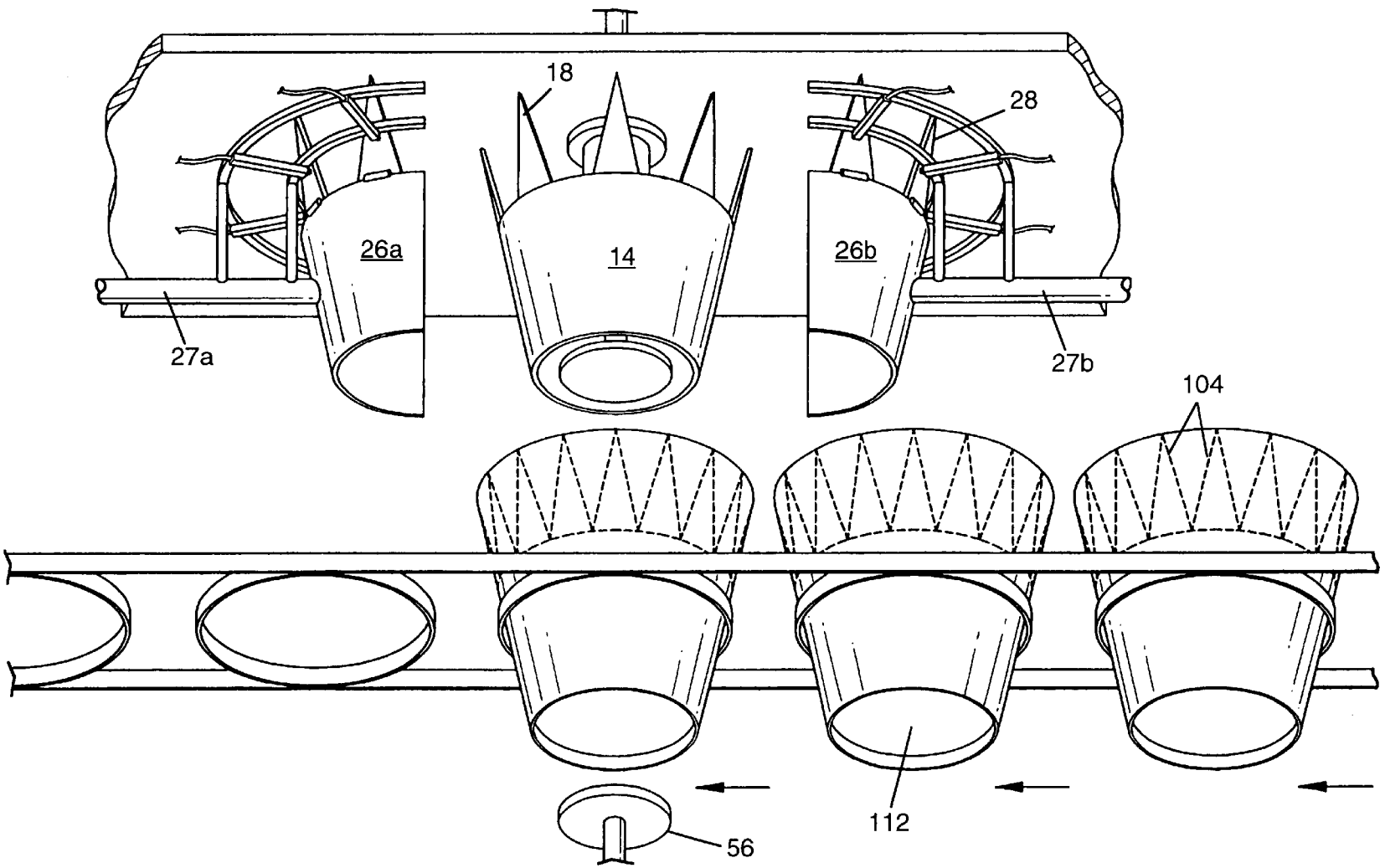
FIG. 10 is an elevation view that shows the progression of box blanks on the loading track for positioning directly adjacent the pedestal.
Figure 11:
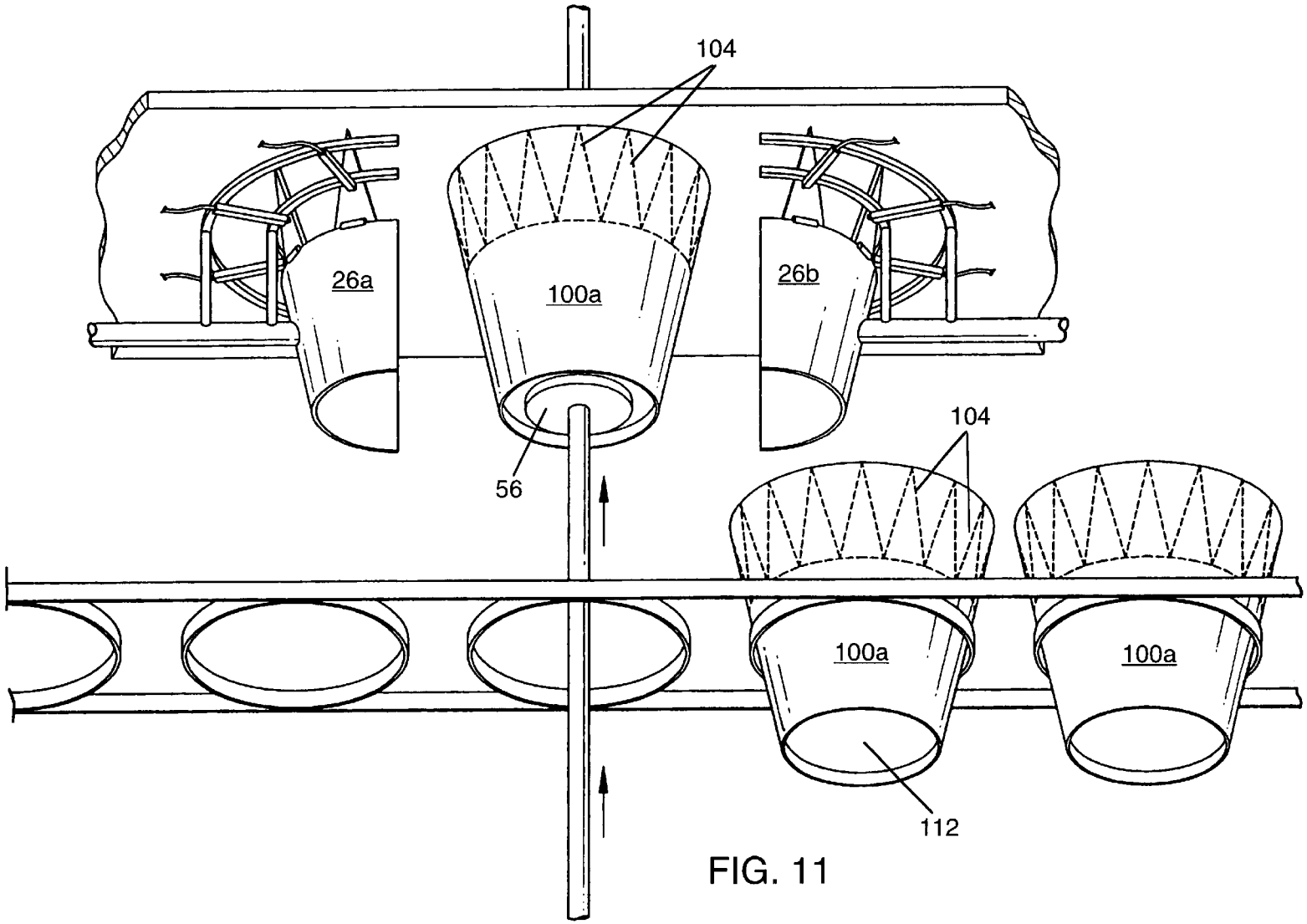
FIG. 11 shows a box blank installed on the pedestal by the bottom driver.

Reference to FIG. 9, FIG. 10 and FIG. 11, indicates that in an alternative embodiment for the boxes, the box blanks 100*a* designated for installation on the pedestal 14 may have a flat, pre-sealed bottom section 112. The blanks 100 or 100*a* proceed on a loading track for positioning directly adjacent the pedestal 14, whereupon each box blank 100 or 100*a* is installed on the pedestal 14 by the bottom driver 56.

Figure 12:
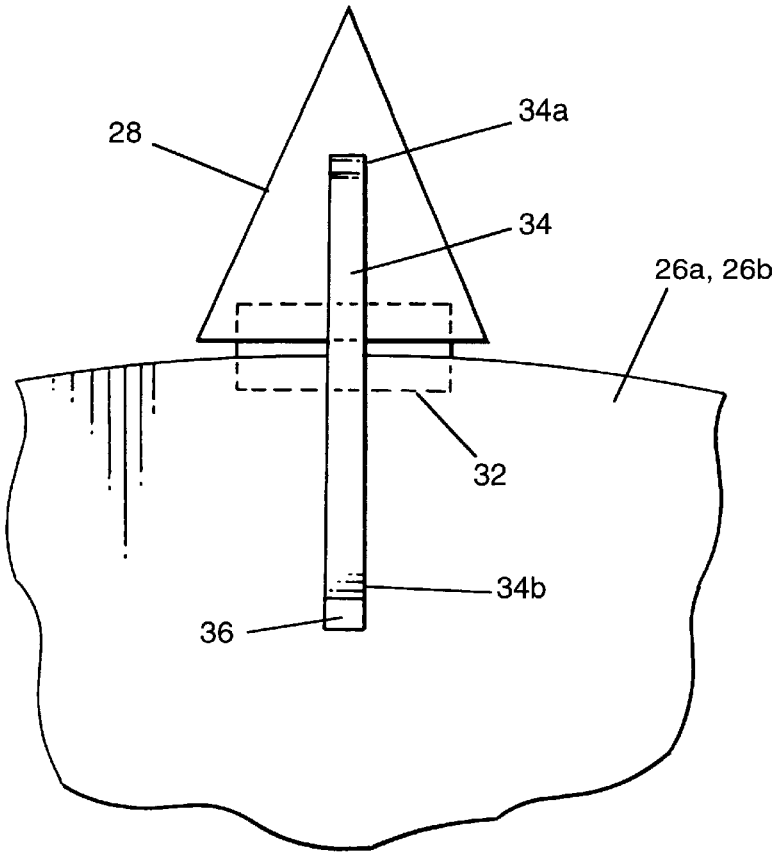
FIG. 12 is an elevational view of a press finger.
Figure 13:
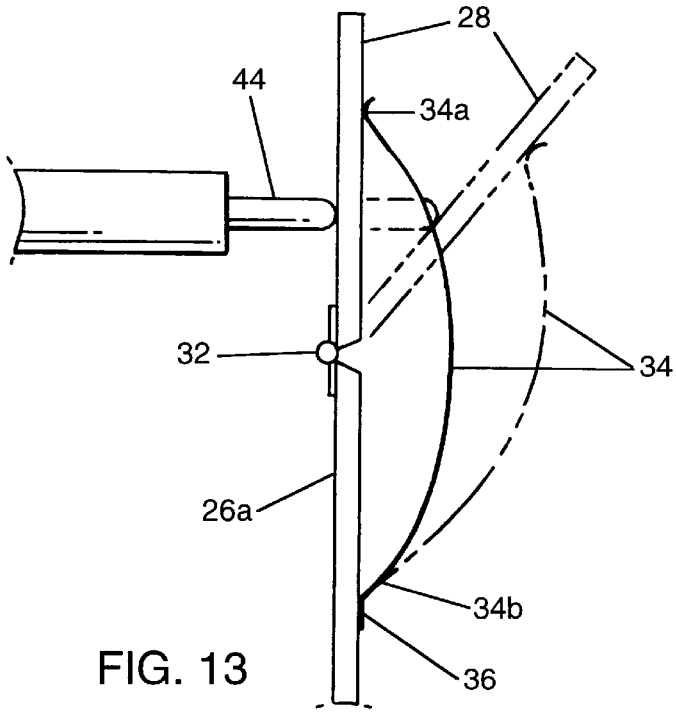
FIG. 13 is an elevation taken at right angles to the view shown in FIG. 12.

As noted in FIGS. 12 and 13, each of the press fingers is pivotally joined to the press sides by a flat hinge 32. The hinge is designed to swing through an arc of about 180° from the closed to the fully open position. When open, each of the press fingers 28 typically is coplanar with the sides 26*a*,26*b* of the press. Shown is an external steel spring 34 with one end 34*a* in contact with the finger 28 and the other end 34*b* secured to the press side 26*a* by suitable means such as a spot weld 36. In operation, each press finger 28 is pivoted about flat hinge 32 from the vertical position in contact with the periphery of the container to a predetermined position (shown in outline) where the periphery is creased. Then, as the fluid pressure against the pin 44 is released, the spring 34 on the side of the press finger 28 opposite the pin urges the finger back to its normal vertical position.

Figure 15:
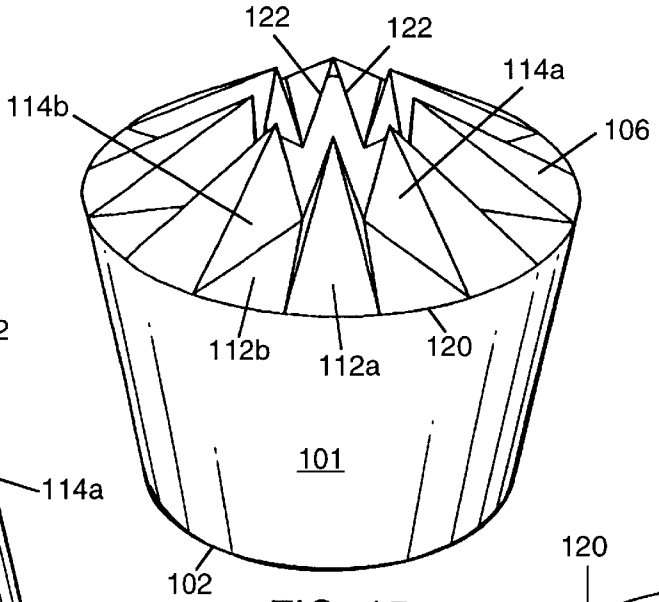
FIG. 15 is perspective view of the container blank of FIG. 14 showing a partially closed end.
Figure 16:
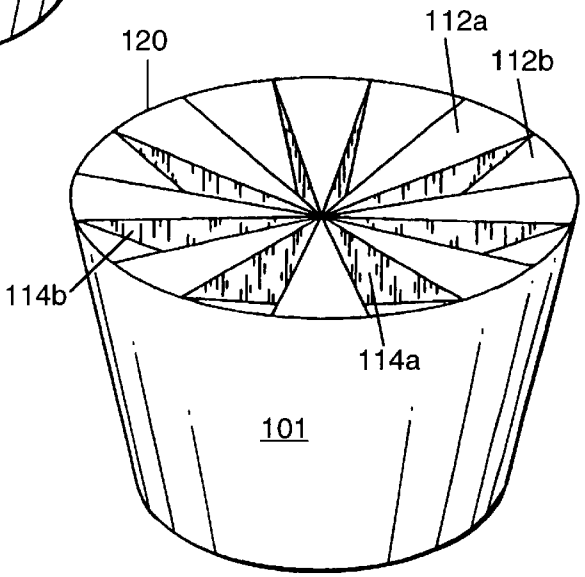
FIG. 16 is a perspective view of the container with both ends completely closed.
Figure 14:
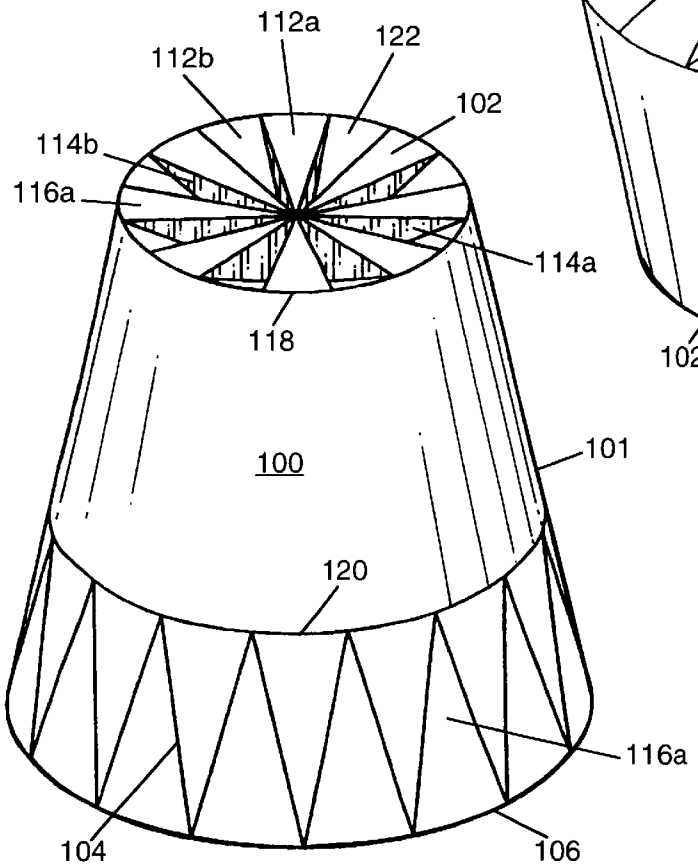
FIG. 14 is a perspective view of the precreased frusto-conical container blank seen in FIG. 8 with the top flap completely folded inward with a plurality of pyramidal fanfolds crimped to form a closure.

Referring now to FIGS. 14–16, a container blank which has been scored, creased and folded according to the teachings of the present invention is shown. The blank 100 comprises a body portion 101, a closed first end flap 102 and second creased but unfolded end flap 106. The flaps are creased along fold line 118,120 to fold in toward the axial center line of the blank. FIG. 14 shows the first flap 102 closed in on itself. The flap is composed of a plurality of fanfold ribs in the shape of pyramids 116*a* formed by the folding of the flap along the creased score lines 104. Each rib is composed of a first set of triangles 112*a*, 112*b* and a second set of triangles 114*a*, 114*b*. All of the triangles are of equal size and all are in the form of isosceles triangles, the height of which is equal to the radius of the closure circle. The first set of triangles are formed with their bases along fold line 118. Their planes diverge from one another as they extend radially inwardly from the fold line to the center axis of the container. Conversely, the second set of triangles 114*a*,114*b* have their bases along the axis and their planes diverge from one another as they extend radially outwardly from the axis toward the fold line, terminating at the apex between the bases of the adjacent triangles in the first set 112*a*, 112*b* along the fold line 118.

In like manner, FIGS. 15 and 16 show the container of FIG. 14 set upon the closed flap 102. FIG. 15 shows the second flap 106 folded upon itself preparatory to complete closure. All of the first set of triangles 112*a*, 112*b* have been folded along the linear fold line 120 extending around the periphery of the container 101, and extend radially inwardly the center of the container. Their respective planes diverge from one another as they extend from fold line toward the axis. The second set of triangles 114*a*, 114*b* connect the first set of triangles with one another. The bases 122 of the second set of triangles converge toward one another to form a crimp line along the axis of the container thereby forming a complete closing of the flap upon itself. When the flap is completely closed as shown in FIG. 16, the second set of triangles is at right angles to the first set.

Figure 17:
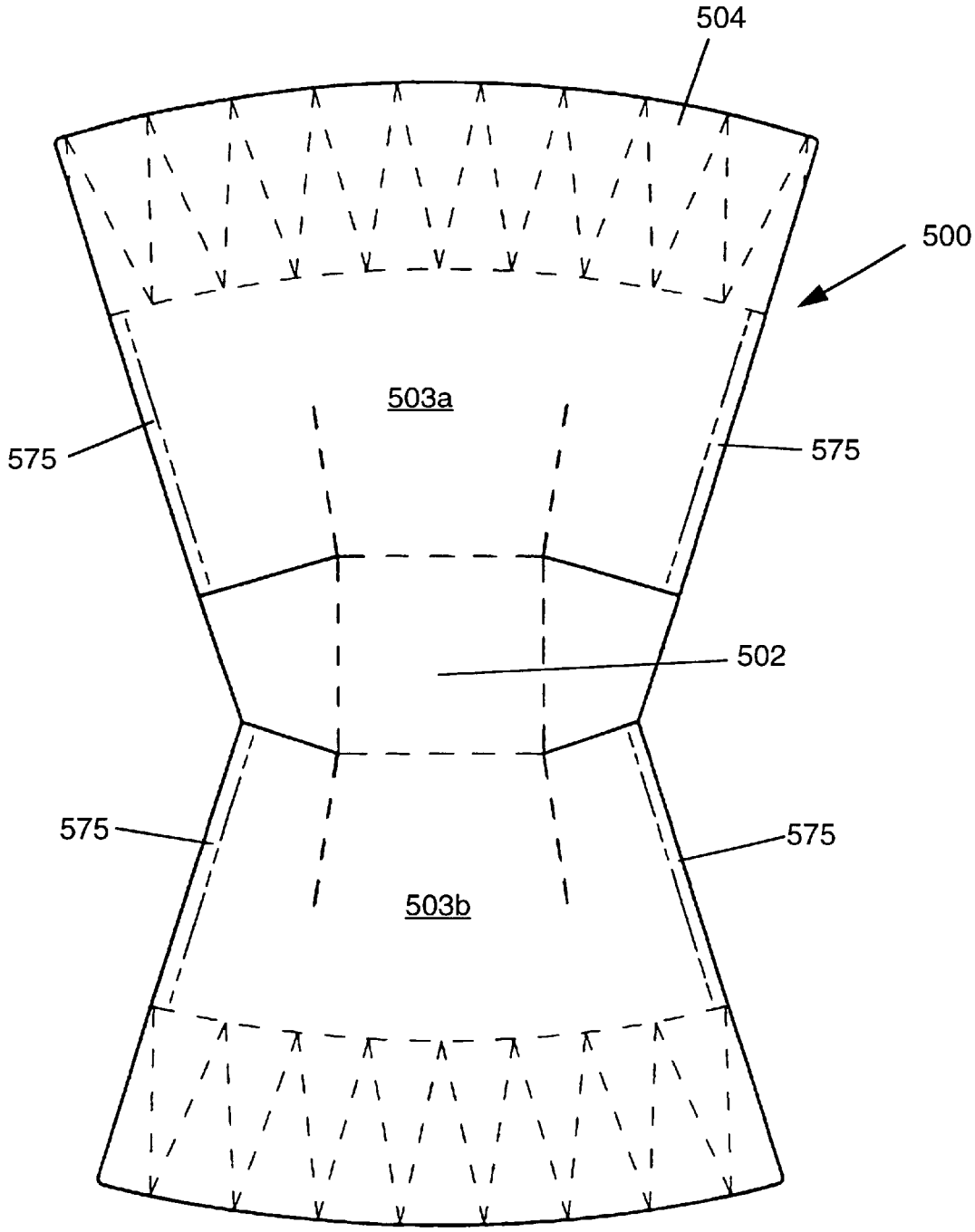
FIG. 17 is a top view of a box blank for forming a flat bottom container with a reclosable fanfold closure top of the container.

As shown in FIG. 17, the box blank 500 for container formation includes score lines for creasing along those lines, whereby the container product has a flat bottom 502 and a top opening with a fanfold closure 504.

Figure 18:
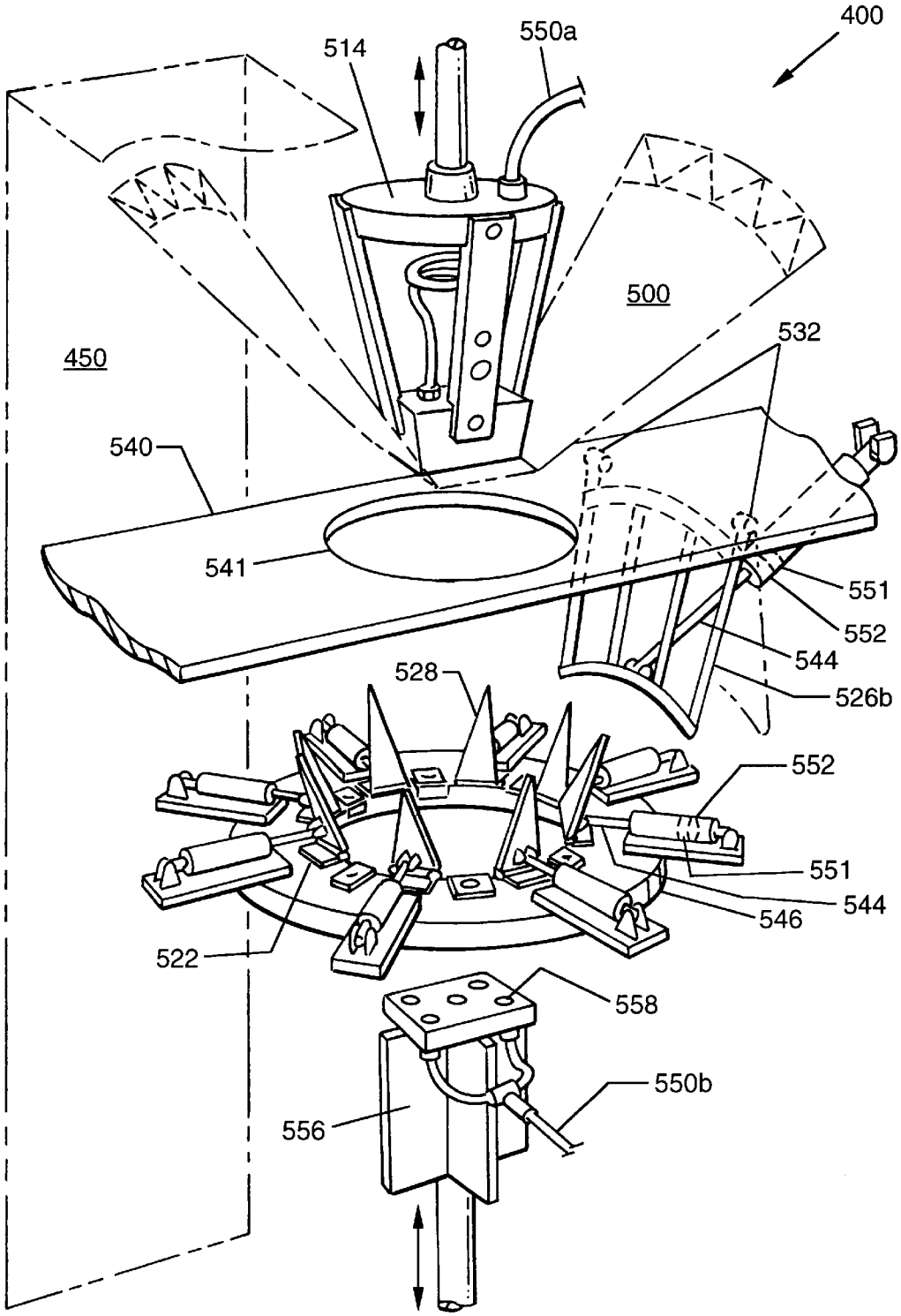
FIG. 18 is a perspective view of the folding machine including the forming head press retaining a box blank above the deck with the right forming hand hinged to the deck, the mounting ring with press fingers and retrieval arm below.

Another embodiment of the invention, shown in FIG. 18, the folding machine 400 of the invention includes a housing 450 with forming head 514 having downward and return cycles that is shown suspended above the deck 540 in a return cycle or upward position. The box blank 500 is stabilized on the forming head. An opening 541 in the deck allows the forming head to pass therethrough in its downward cycle. The forming head 514 and retrieval arm 556 are both equipped with vacuum pressure tubes 550*a,* 550*b* communicating with orifices 558 on respective operating surfaces for alternately retaining the box blank in position on the forming head 514 for passage to the retrieval arm 556 following the first step of the container formation. The right side forming hand 526*b* is connected by hinges 532 to the underside of the deck 540 and connected to its respective shaft 544 with a pneumatic driven piston 551 within a cylinder 552 also fixed to the deck.

The mounting ring 546 fixed within the housing 450 below the deck 540 sustains the press fingers 528 that are joined to the ring by hinges 522 and shown with each press finger having a connected shaft 544 that extends from a pneumatic cylinder 552 fixed on the ring to the movable finger. As such, each of the press fingers 528 is moved forward and back by action of a piston 551 within the cylinder 552 pushing and pulling the shaft to simultaneously move each of the fingers. The pistons 551 are moved by pneumatic pressure on either side of each piston provided through tubing 580 connected through inlets 555*a,*555*b* to the cylinders. (See FIGS. 22 and 23.)

Figure 19:
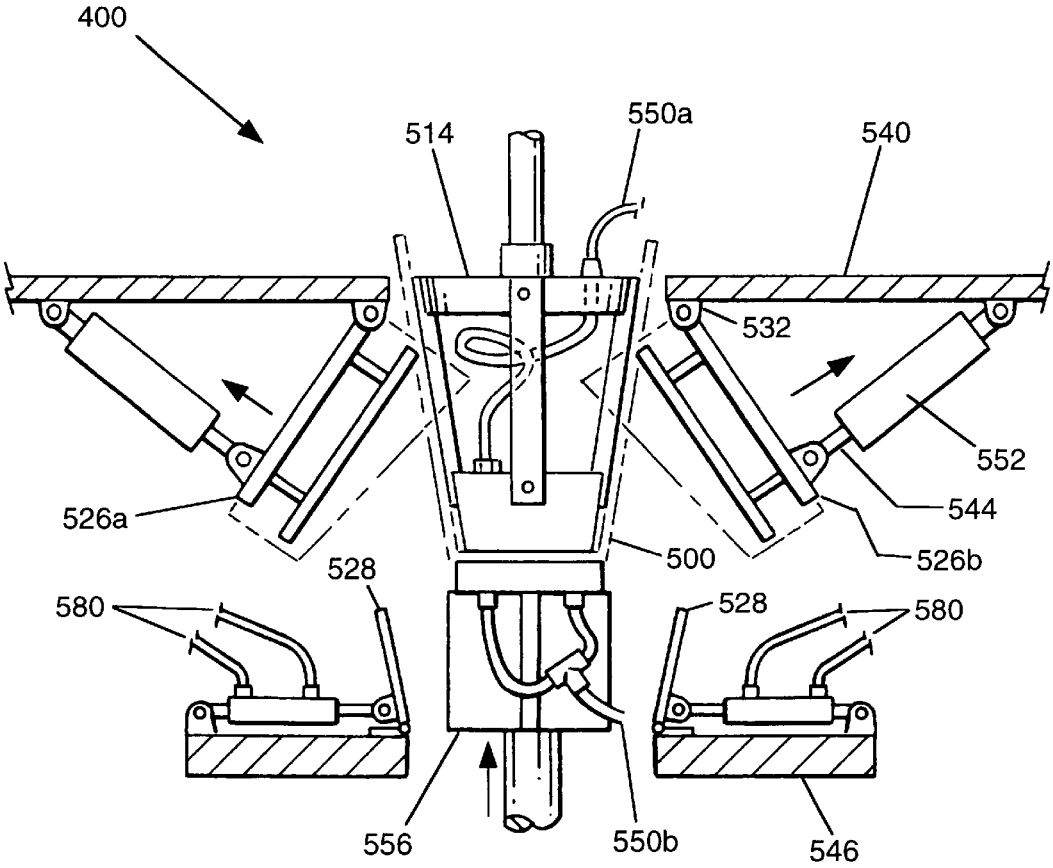
FIG. 19 is a side view of the folding machine showing the deck with the forming head press in its downward cycle position, the right and left forming hands in open position, the retrieval arm urging the box blank downward for alignment with the press fingers mounted on the ring.

FIG. 19 demonstrates action of the retrieval arm 556 to clasp the box 500 for downward pull toward the ring 546 and alignment with the press fingers 528. At this point, the box has been formed to the shape of a cut conical section by sealing glue seams 575 along the sides of the box blank 500 by application of the compression bars 527, (See FIG. 22), over each of the glue seams upon compression of the box sides 503*a,*503*b* over the formation head press 514 by the forming hands 526*a,*526*b*.

Figure 20:
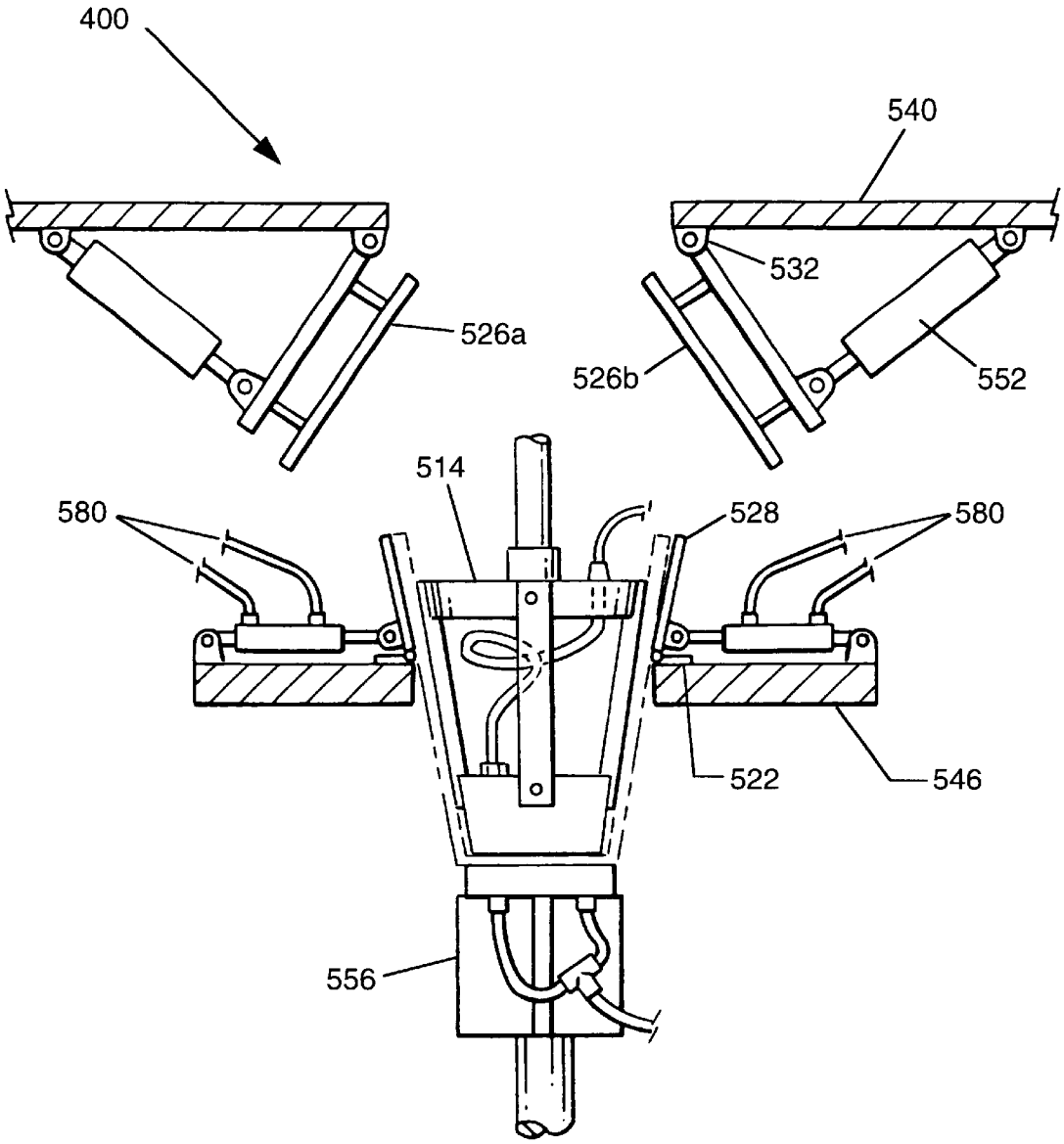
FIG. 20 is a side view of the folding machine, the fanfold top of the box blank aligned with the press fingers.
Figure 21:
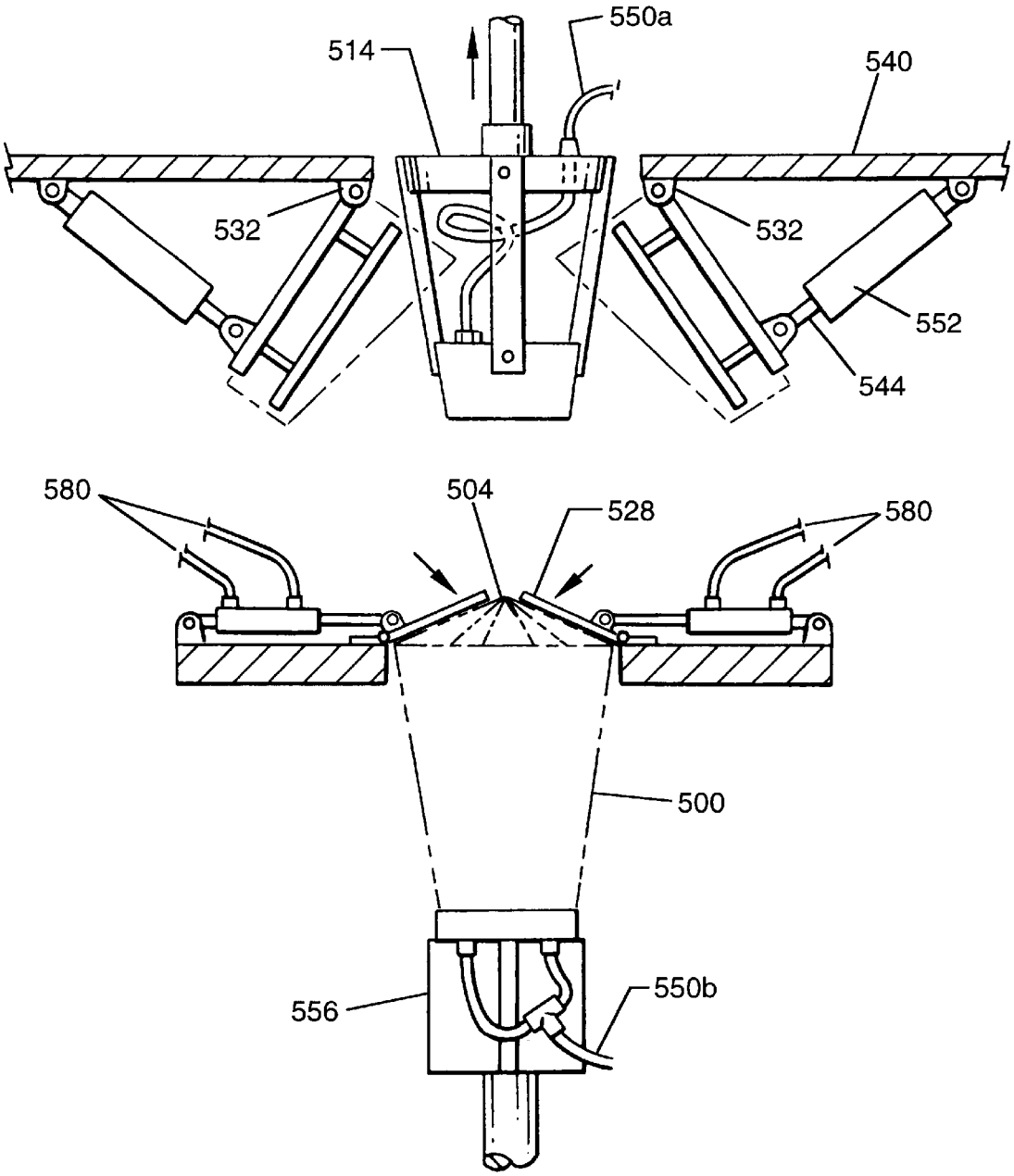
FIG. 21 is a side view of the folding machine showing the press fingers creasing the fanfold closure top of the container.
Figure 23:
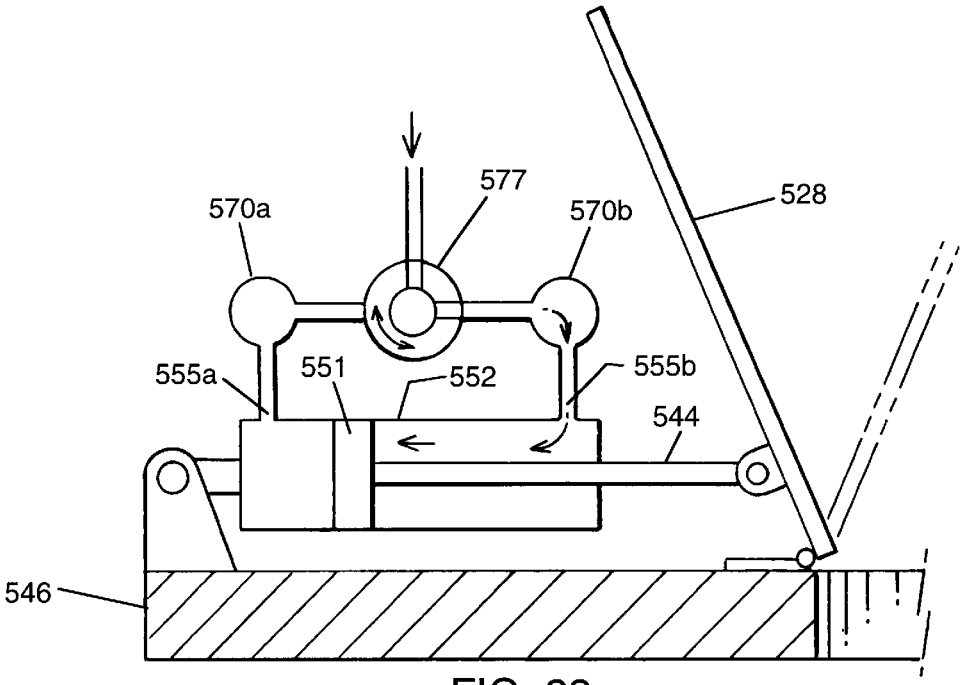
FIG. 23 is a side plan showing a press finger with its respective pneumatic drive means.

The partially formed container proceeds downward by action of the retrieval arm 556 for position within the ring 546 at a level corresponding to the press fingers 528 as shown in FIG. 20. The fanfold top 504 is then creased along the score lines of the box blank by simultaneous inward or forward action of the press fingers 528 that is indicated in FIG. 21. The fingers are impelled by the shaft 544 connected to each finger and to a pneumatically driven piston 551 within a cylinder 552 having right and left inlets 555*a,*555*b*. Compressed air is preferable for providing the pneumatic force to each cylinder. As shown in FIG. 23, the air is forced into each cylinder 552 through a manifold 577 for re-direction to right and left air valves 570*a,*570*b*.

Figure 22:
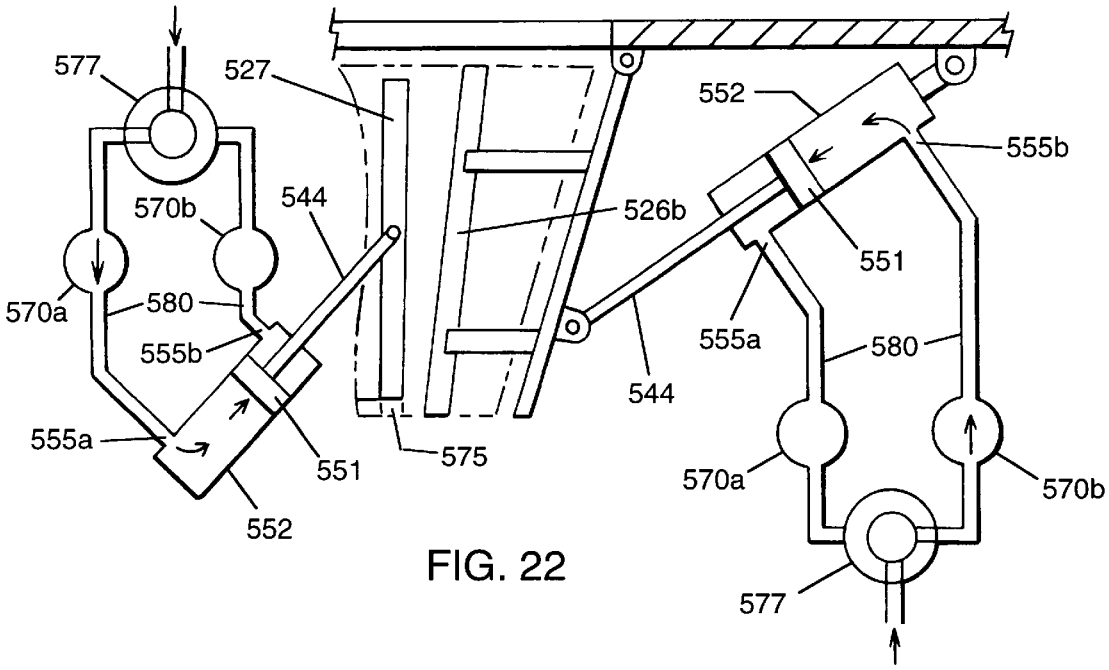
FIG. 22 is a side plan showing a compression bar and its drive cylinder, pneumatic piston and drive shaft communicating with a manifold through right and left air valves, the right forming hand with its respective drive cylinder and pneumatic piston and drive shaft, manifold and air valves.

As shown in FIG. 22, operation of the forming hands 526*a,*526*b* to compress sides of the box blank and actuation of the compression bars 527 to seal the glue seams 575 are likewise operated by pneumatic force, preferably air pressure that enters the cylinder through air valves as directed by the manifold 577. After container formation and folding by the press fingers 528, the pre-folded container can be automatically or manually removed from the retrieval arm. The containers thus formed remain sufficiently open to be stacked in nested formation. A sequential supply of air pressure to the forming hands and compression bar cylinders, followed by simultaneous supply of compressed air to the press finger cylinders, is achieved using an electro-cam (not shown), that communicates with the manifolds for appropriate, timely air pressure to operate of the machine for manufacture of up to 10,000 containers per hour. The sequential supply of pneumatic and air pressure to each cylinder is synchronized for continuous automatic machine operation without interruption.

Figure 24:
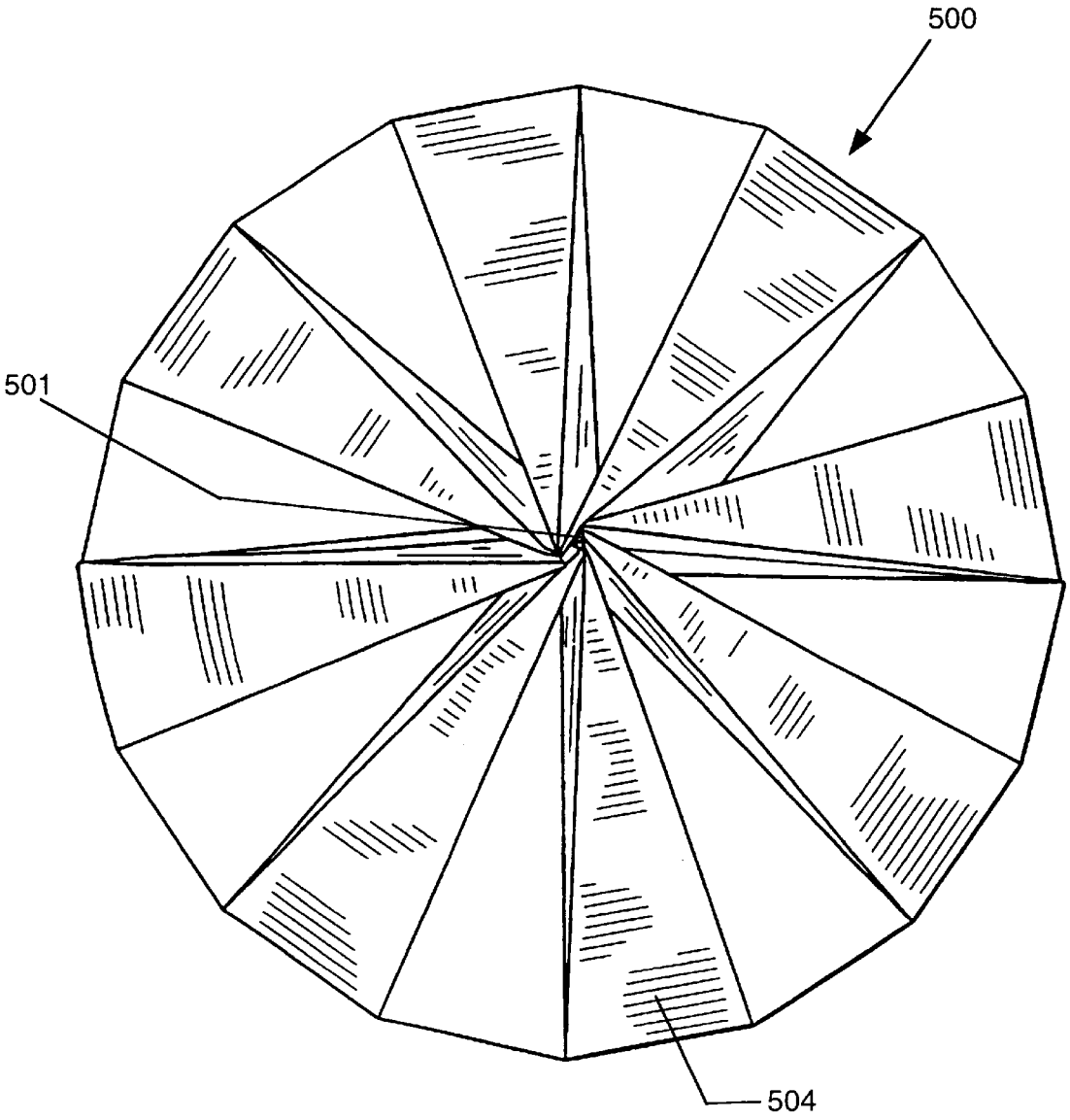
FIG. 24 is a top view of the fanfold container formed by the machine using the box blank of FIG. 17.

The folding machine of this invention provides a container that remains closed by an area of stability with a frictional inertia due to contact of the pyramidals, (i.e., upward or downward projecting pyramids formed by successive adjacent triangles), at the fanfold center 501, as shown in FIG. 24, without a tab or other locking mechanism.

Unlike many of the prior art closures, the closures formed according to the present invention can be repeatedly opened and closed with minimal wear. The fold lines and the edges of the container blank are coplanar and linear with no need to form curved, scalloped or sawtooth edges The individual pyramids do not overlap and fold over one another, nor is there any need to twist the container relative to the flap when closing the container.

The preceding detailed description should be considered exemplary in nature and not limited to the scope and spirit of the invention as set forth in the appended claims.

I claim:

1. A container folding machine for construction of containers using box blanks having score lines, in preparation for completion of the container formation by folding, the machine comprising:

a male pedestal in a fixed position that comprises an inner pattern adapted to receive a box blank that is installed on the inner pattern;

a press comprising an outer pattern that is adapted for closure over the inner pattern;

means to crease each of the box blanks along its score lines for formation of a pre-folded container; and, the pedestal further comprising upper and lower pedestal edges with repositioning pedestal fingers connected to the pedestal edges.

2. A container folding machine according to claim 1, further comprising pedestal hinges for connecting each of the fingers to the pedestal.

3. A container folding machine according to claim 2, wherein the pedestal fingers have inward and upright positions.

4. A container folding machine as described in claim 3, further comprising press sides that form an outer pattern for closure over a box blank that is installed on the pedestal.

5. A container folding machine as described in claim 4, wherein the pedestal hinges are spring loaded to bias the hinges in a normally upright position, whereby the pattern fingers of the inner pedestal are adapted to receive a downward pressure by the outer pattern.

6. A container folding machine as described in claim 5, the press sides further comprising repositioning press fingers that are adapted for inward movement against the inner pattern.

7. A container folding machine as described in claim 6, further comprising flat hinges for connecting the press fingers to the press sides.

8. A container folding machine according to claim 5, further comprising an armature for controlling movement of each press for closure upon and withdrawal from the box blank installed on the pedestal.

9. A container folding machine according to claim 8, each press further comprising a top and bottom periphery and pin stabilizers that surround each press near the top and bottom periphery thereof.

10. A container folding machine as described in claim 9, wherein the means to crease the paperboard along its score lines for formation of a pre-folded container comprises air driven pins that are mounted on the pin stabilizers on the top and bottom periphery of each of the press sides and adjacent to a corresponding press finger thereof, for engaging the press fingers that are driven inward by the pins with consequent formation of creases on the score lines.

11. A container folding machine according to claim 10, further comprising a fluid lead line associated with each of the air driven pins that connects with a common line for a compressed air supply to, and simultaneous action of, each of the pins.

12. A container folding machine as described in claim 11 wherein the containers are constructed of a material comprising paperboard.

13. A container folding machine as described in claim 12, wherein the box blank has scored top and bottom sections and the machine is adapted for simultaneously pre-folding both the container top and bottom sections.

14. A container folding machine as described in claim 12, wherein the box blank has a reclosable bottom section and the machine is for pre-folding the container bottom section.

15. A container folding machine as described in claim 12, wherein the box blank has a flat, pre-sealed bottom section and a reclosable top section and the machine is for pre-folding the container top section.

16. A container folding machine as described in claim 15, further comprising a loading track for positioning a box blank directly adjacent the pedestal; and, a driver shaft for repositioning a box blank from the loading track to installation on the pedestal.

17. A machine for prefolding one end of a container blank along score lines, said container blank having an interior surface and an exterior surface, said machine containing a plurality of hinged spring biased pedestal fingers positioned at spaced intervals around a central pedestal and joined thereto by spring-loaded hinges at spaced intervals, and a plurality of press fingers spaced intermediate said pedestal fingers, means to bias each of the press fingers about a hinge, the pedestal fingers positioned around the interior surface of the container blank and the press fingers adapted to be positioned around the exterior surface of said blanks.

18. A machine according to claim 17, wherein the pedestal fingers and the press fingers are in the shape of isosceles triangles to register with contiguous triangles scored around the end of the container blank.

19. A container folding machine for construction of containers using box blanks having score lines outlining a box bottom, opposite sides each having a glue seam thereon and a fanfold top, comprising:

a stationary deck with an opening and a forming press with a contact surface, a downward stroke and a return cycle suspended on a shaft above the deck opening to press the box blank bottom through the opening in the downward stroke of the forming press;

a box forming assembly including a pair of pneumatically driven forming hands with open and closed positions and lateral ends, each hand positioned on an underside of the stationary deck on opposite sides of the opening, for compression of the box sides by closure of the forming hands;

a stationary folding ring positioned below the deck and including a plurality of press fingers surrounding an inner diameter of the stationary folding ring, each finger connected to a shaft actuated by a pneumatic cylinder for forward and back movement of each finger; and, a retrieval arm co-axial with the forming press and having a contact surface, an upward stroke and an alignment position to receive the box blank from the press on the upward stroke, and align the box blank top with said fingers, whereby concurrent forward movement of the fingers folds the top in a fanfold configuration along the score lines and around a top box opening.

20. The container folding machine according to claim 19, the box sides further comprising glue seams; and, the box forming assembly further comprising a pair of pneumatically driven compression bars with open and closed positions, each bar hinged to an underside of the deck on opposite sides of the opening between the lateral ends of the forming hands, to seal the box blank by closure of the bars on the seams.

21. The container folding machine according to claim 20, further comprising a vacuum source and wherein the forming hand and the retrieval arm include vacuum pressure tubes communicating vacuum pressure to orifices on said contact surfaces, for alternately retaining the box blank on the forming press for container formation and passage to the retrieval arm for alignment with the fingers.

22. The container folding machine according to claim 21, further comprising a pneumatic pressure source and wherein each of the plurality of press fingers is joined to the ring by a hinge and connected to a shaft extending from a pneumatic cylinder fixed on the ring including a piston driven by pneumatic pressure through pressure tubing from the pneumatic pressure source and connected through right and left inlets to the pneumatic cylinder on each side of the piston to drive the piston and its respective finger forward and back to pre-fold the box blank top in the fanfold configuration.

23. The container folding machine according to claim 22, each cylinder further comprising an associated manifold in fluid communication with its respective cylinder through right and left air valves to the right and left inlets of each cylinder, for redirection of air pressure to each side of the cylinder by the manifold.

24. The container folding machine according to claim 22, wherein a sequential supply of pneumatic pressure to each cylinder is synchronized for continuous automatic machine operation without interruption.

25. The folding machine of claim 24, wherein the machine provides in each container made by the machine an area of stability with a frictional inertia, associated with contact of a plurality of pyramidals each comprising three adjacent triangles at a fanfold center of the fanfold configuration, whereby that the container remains closed without a tab or other mechanism.

* * * * *